US011337487B2

(12) United States Patent
Orand

(10) Patent No.: US 11,337,487 B2
(45) Date of Patent: May 24, 2022

(54) SOLE STRUCTURE FOR AN ARTICLE OF FOOTWEAR HAVING A NONLINEAR BENDING STIFFNESS

(71) Applicant: NIKE, Inc., Beaverton, OR (US)

(72) Inventor: Austin Orand, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1095 days.

(21) Appl. No.: 15/670,622

(22) Filed: Aug. 7, 2017

(65) Prior Publication Data

US 2018/0042338 A1 Feb. 15, 2018

Related U.S. Application Data

(60) Provisional application No. 62/373,568, filed on Aug. 11, 2016.

(51) Int. Cl.

| | |
|---|---|
| ***A43B 13/12*** | (2006.01) |
| ***A43B 13/14*** | (2006.01) |
| ***A43B 13/00*** | (2006.01) |
| ***A43B 13/04*** | (2006.01) |
| ***A43B 13/18*** | (2006.01) |
| ***A43B 13/22*** | (2006.01) |

(52) U.S. Cl.

CPC ..... *A43B 13/04* (2013.01); *A43B 13/122* (2013.01); *A43B 13/125* (2013.01); *A43B 13/141* (2013.01); *A43B 13/184* (2013.01); *A43B 13/186* (2013.01); *A43B 13/188* (2013.01); *A43B 13/223* (2013.01); *A43B 13/00* (2013.01)

(58) Field of Classification Search

CPC ..... A43B 13/04; A43B 13/122; A43B 13/125; A43B 13/141; A43B 13/184; A43B 13/186; A43B 13/188; A43B 13/223; A43B 13/00

USPC ..... 36/25 R, 30 A, 31

See application file for complete search history.

(56) References Cited

U.S. PATENT DOCUMENTS

| | | | | |
|---|---|---|---|---|
| 634,588 | A | 10/1899 | Roche | |
| 1,892,596 | A * | 12/1932 | Wood | A43B 9/06 36/19.5 |
| 1,964,406 | A | 6/1934 | Pellkofer | |
| 2,072,785 | A | 3/1937 | Wulff | |

(Continued)

FOREIGN PATENT DOCUMENTS

| | | | |
|---|---|---|---|
| DE | 315919 | C | 11/1919 |
| DE | 202007000831 | U1 | 5/2007 |

(Continued)

*Primary Examiner* — Jocelyn Bravo

(74) *Attorney, Agent, or Firm* — Quinn IP Law

(57) ABSTRACT

A sole structure for an article of footwear comprises a first sole plate that includes a forefoot region, a foot-receiving surface, and a lower surface opposite the foot-receiving surface. The first sole plate has a plurality of slots including a first slot, and a second slot rearward of the first slot. The plurality of slots is disposed in the forefoot region and extends generally transversely and entirely through the first sole plate from the foot-receiving surface to the lower surface. The sole structure includes at least one rib, referred to as a first rib, disposed between the first slot and the second slot. The sole structure also includes a second sole plate secured to the lower surface of the first sole plate both forward of the plurality of slots and rearward of the plurality of slots. The second sole plate is detached from the first rib.

13 Claims, 11 Drawing Sheets

(56) References Cited

U.S. PATENT DOCUMENTS 2,207,632 A * 7/1940 Margolin ..... A43B 7/06 36/3 R
2,211,057 A * 8/1940 Duckoff ..... A43B 13/141 36/103
2,224,590 A * 12/1940 Boivin ..... A43B 17/08 36/3 B
2,342,188 A 2/1944 Ghetz et al.
2,342,466 A 2/1944 Gordon
2,379,139 A * 6/1945 Flink ..... A43B 13/42 36/19.5
2,413,545 A 12/1946 Cordi
2,470,200 A 5/1949 Wallach
2,478,664 A 8/1949 Morrow et al.
2,537,123 A 1/1951 Dowling, Sr.
2,640,283 A 6/1953 McCord
2,922,235 A 1/1960 Meltzer
3,039,207 A 6/1962 Lincors
3,067,752 A * 12/1962 Schaller ..... A43B 13/04 36/145
3,782,011 A 1/1974 Fisher
4,026,045 A 5/1977 Druss
4,255,877 A 3/1981 Bowerman
4,391,048 A 7/1983 Lutz
4,476,638 A * 10/1984 Quacquarini ..... A43B 7/28 36/103
4,573,457 A 3/1986 Parks
4,658,514 A * 4/1987 Shin ..... A43B 5/06 36/30 R
4,779,361 A * 10/1988 Kinsaul ..... A43B 13/141 36/102
4,839,972 A 6/1989 Pack et al.
4,894,932 A * 1/1990 Harada ..... A43B 7/088 36/3 R
4,920,665 A 5/1990 Pack et al.
4,930,231 A * 6/1990 Liu ..... A43B 13/02 36/30 A
4,936,028 A 6/1990 Posacki
4,941,273 A 7/1990 Gross
5,243,776 A 9/1993 Zelinko
5,392,537 A 2/1995 Goldberg
5,461,800 A * 10/1995 Luthi ..... A43B 13/181 36/114
5,572,806 A 11/1996 Osawa
5,729,912 A 3/1998 Gutkowski et al.
6,092,309 A 7/2000 Edwards
6,125,556 A 10/2000 Peckler et al.
6,202,326 B1 3/2001 Hauglin
6,237,255 B1 5/2001 Renaudin et al.
7,100,308 B2 9/2006 Aveni
7,143,530 B2 12/2006 Hudson et al.
7,401,422 B1 7/2008 Scholz et al.
7,513,065 B2 4/2009 Kita et al.
8,117,770 B2 2/2012 Wong
8,365,444 B2 2/2013 Youngs
8,578,629 B2 11/2013 Bosomworth et al.
8,646,191 B2 2/2014 Amos et al.
9,179,733 B2 11/2015 Peyton et al.
10,226,097 B2 3/2019 Farris et al.
2001/0007177 A1 7/2001 Brown, Jr. et al.
2004/0091675 A1 5/2004 Yang
2004/0250446 A1* 12/2004 Greene ..... A43B 13/10 36/25 R
2005/0000115 A1 1/2005 Kimura et al.
2005/0039350 A1* 2/2005 Hung ..... A43B 13/141 36/107
2006/0117600 A1 6/2006 Greene
2006/0254087 A1 11/2006 Fechter
2007/0039208 A1 2/2007 Bove et al.
2007/0169376 A1* 7/2007 Hatfield ..... A43B 13/125 36/29
2007/0266598 A1* 11/2007 Pawlus ..... A43B 13/187 36/88
2008/0066348 A1 3/2008 O'Brien et al.
2008/0263900 A1 10/2008 Determe et al.
2009/0193682 A1* 8/2009 Rosenbaum ..... A43B 13/187 36/88
2010/0139122 A1 6/2010 Zanatta
2010/0218397 A1 9/2010 Nishiwaki et al.
2011/0047816 A1 3/2011 Nurse
2011/0214313 A1* 9/2011 James ..... A43B 13/141 36/103
2012/0036739 A1 2/2012 Amos et al.
2012/0055047 A1 3/2012 Youngs
2012/0324761 A1* 12/2012 Sills ..... A43B 1/0072 36/103
2013/0125416 A1* 5/2013 Hoffer ..... A43B 13/187 36/83
2013/0326911 A1 12/2013 Baucom et al.
2014/0013624 A1* 1/2014 Stockbridge ..... A43B 13/181 36/103
2014/0182167 A1 7/2014 James et al.
2014/0223778 A1 8/2014 Horacek
2014/0250723 A1* 9/2014 Kohatsu ..... A43B 3/26 36/88
2014/0259744 A1* 9/2014 Cooper ..... A43B 13/122 36/28
2014/0366401 A1 12/2014 Cavaliere et al.
2015/0027005 A1 1/2015 Lee et al.
2015/0047222 A1 2/2015 Rushbrook
2015/0089841 A1* 4/2015 Smaldone ..... A43B 13/181 36/103
2015/0173456 A1* 6/2015 Rushbrook ..... A43B 5/001 36/25 R
2015/0230548 A1* 8/2015 Cross ..... A43B 1/0009 36/104
2015/0282557 A1 10/2015 Kirk et al.
2015/0289586 A1* 10/2015 Wan ..... A43B 13/125 36/31
2017/0079374 A1 3/2017 Farris et al.
2017/0079375 A1 3/2017 Bunnell et al.
2017/0079376 A1 3/2017 Bunnell et al.
2017/0079378 A1 3/2017 Farris et al.
2017/0127755 A1* 5/2017 Bunnell ..... A43B 5/02
2017/0340055 A1 11/2017 Schneider
2017/0340056 A1 11/2017 Bunnell et al.
2017/0354200 A1 12/2017 Orand et al.
2017/0367439 A1 12/2017 Fallon
2018/0027922 A1 2/2018 Orand

FOREIGN PATENT DOCUMENTS

DE 102012104264 A1 11/2013
EP 1127504 A2 8/2001
EP 1483981 A1 12/2004
EP 2926678 A2 10/2015
FR 892219 A 3/1944
FR 2974482 A1 11/2012
WO 03075698 A1 9/2003
WO 2006087737 A1 8/2006
WO 2011005728 A1 1/2011

* cited by examiner 10
25
5
LM
14
24A
30
28
28
30
28
28
28

SOLE STRUCTURE FOR AN ARTICLE OF FOOTWEAR HAVING A NONLINEAR BENDING STIFFNESS

CROSS-REFERENCE TO RELATED APPLICATION

This application claims the benefit of priority to U.S. Provisional Application No. 62/373,568 filed Aug. 11, 2016, which is hereby incorporated by reference in its entirety.

TECHNICAL FIELD

The present teachings generally include a sole structure for an article of footwear.

BACKGROUND

Footwear typically includes a sole structure configured to be located under a wearer's foot to space the foot away from the ground. Sole assemblies in athletic footwear are typically configured to provide cushioning, motion control, and/or resiliency.

DESCRIPTION

Figure 1:
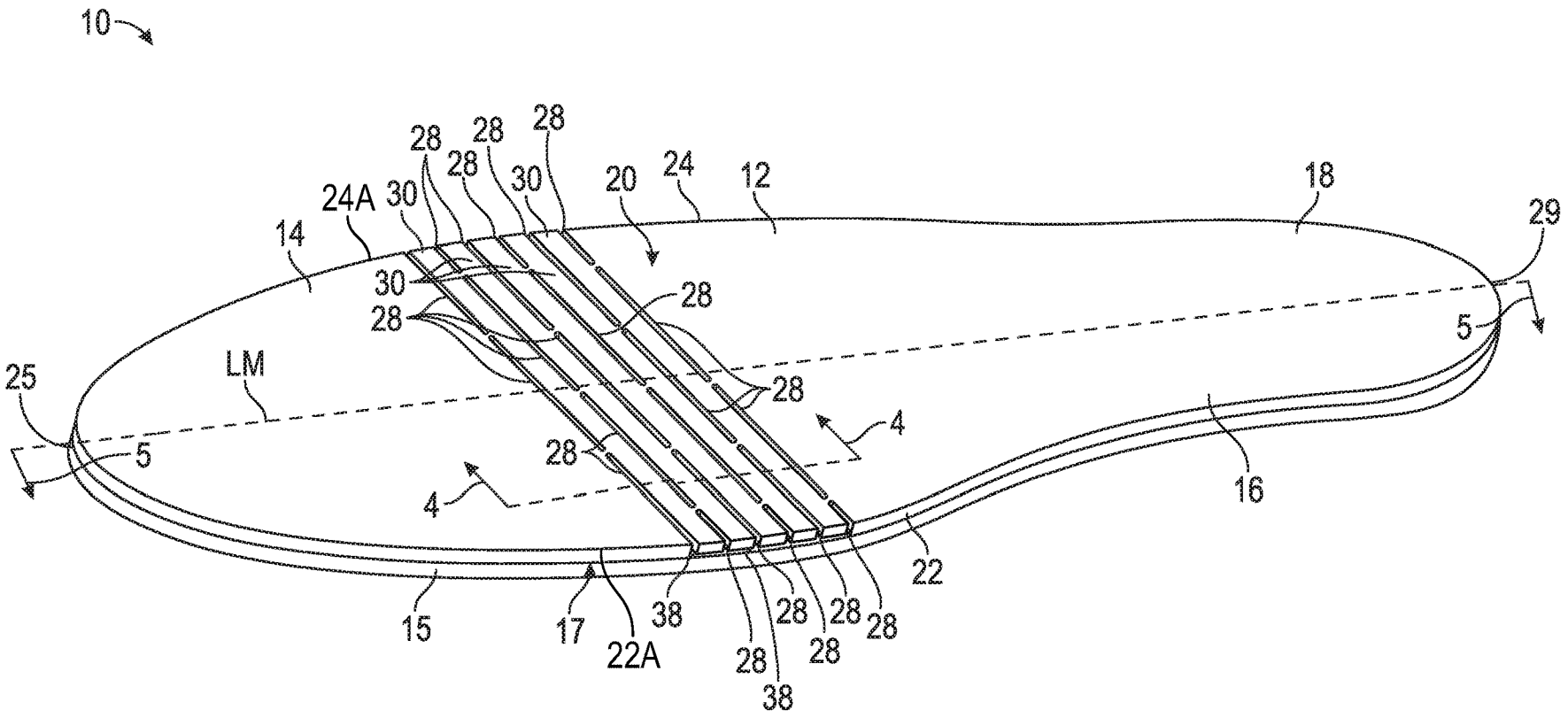
FIG. 1 is a schematic illustration in perspective view of a sole structure for an article of footwear in an unflexed position.

A sole structure for an article of footwear comprises a first sole plate that includes a forefoot region, a foot-receiving surface, and a lower surface opposite the foot-receiving surface. The first sole plate has a plurality of slots including a first slot, and a second slot rearward of the first slot. The plurality of slots is disposed in the forefoot region and extends generally transversely and entirely through the first sole plate from the foot-receiving surface to the lower surface. The sole structure includes at least one rib, referred to as a first rib, disposed between the first slot and the second slot. The sole structure also includes a second sole plate secured to the lower surface of the first sole plate both forward of the plurality of slots and rearward of the plurality of slots. The second sole plate is detached from the first rib.

In an embodiment, the first sole plate is integral with the second sole plate. The first sole plate may be one of, or is a unitary combination of any two or more of, an outsole, a midsole, and an insole. The first sole plate may further include a midfoot region and a heel region, and the second sole plate may have a forefoot region, a midfoot region, and a heel region.

In an embodiment, the first slot and the second slot are generally parallel with one another. The first slot and the second slot may extend to a medial side of the first sole plate and to a lateral side of the first sole plate.

The sole structure is configured so that the plurality of slots is open when the sole structure is in a relaxed, un-flexed state, open during dorsiflexion of the sole structure in a first portion of a flexion range, and closed during dorsiflexion of the sole structure in a second portion of the flexion range greater than the first portion of the flexion range.

The sole structure provides a first bending stiffness in the first portion of the flexion range, and a second bending stiffness greater than the first bending stiffness in the second portion of the flexion range. The first portion of the flexion range includes flex angles of the sole structure less than a first predetermined flex angle, and the second portion of the flexion range includes flex angles greater than or equal to the first predetermined flex angle. The sole structure provides a change in bending stiffness at the first predetermined flex angle. In an embodiment, the first predetermined flex angle is an angle selected from the range of angles extending from 35 degrees (°) to 65°. Stated differently, the first predetermined flex angle can be any one of 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, or 65°.

The first rib may rest on an upper surface of the second sole plate when the sole structure is in a relaxed, un-flexed state. Alternatively, the second sole plate may be displaced from the first rib by a vertical gap when the sole structure is in a relaxed, un-flexed state.

In an embodiment, at least one first bridge spans the first slot and connects the first rib with a portion of the first sole plate forward of the first rib. At least one second bridge spans the second slot and connects the first rib with a portion of the first sole plate rearward of the first rib. The at least one first bridge and the at least one second bridge are integral with the first sole plate.

In an embodiment, the first sole plate includes a first set of bridges. Each bridge of the first set of bridges is spaced transversely apart from each other bridge of the first set of bridges, spans the first slot, and connects the first rib with a portion of the first sole plate forward of the first rib. The sole plate may include a second set of bridges. Each bridge of the second set of bridges may be spaced transversely apart from each other bridge of the second set of bridges, span the second slot, and connect the first rib with a portion of the first sole plate rearward of the first rib. The bridges of the first set of bridges may be staggered along the first sole plate in a transverse direction relative to bridges of the second set of bridges.

In an embodiment, the plurality of slots includes a third slot disposed in the forefoot region rearward of the second slot, and the first sole plate further comprises a second rib disposed between the second slot and the third slot. The first rib and the second rib each have a front wall and a rear wall. Each of the plurality of slots is open during dorsiflexion of the sole structure in a first portion of a flexion range, and closed during dorsiflexion of the sole structure in a second portion of the flexion range greater than the first portion of the flexion range. The rear wall of the first rib contacts the front wall of the second rib when the second slot closes.

The sole structure may include a third set of bridges, with each bridge of the third set of bridges spaced transversely apart from each other bridge of the third set of bridges, spanning the third slot, and connecting the second rib with a portion of the first sole plate rearward of the second rib. Bridges of the third set of bridges are aligned with bridges of the first set of bridges in a longitudinal direction along the first sole plate.

In an embodiment, a sole structure for an article of footwear comprises a first sole plate that includes a forefoot region, a foot-receiving surface, a lower surface opposite the foot-receiving surface, a plurality of slots disposed in the forefoot region and extending generally transversely and entirely through the first sole plate from the foot-receiving surface to the lower surface, and a plurality of ribs, with each of the plurality of ribs disposed between and defined by a respective pair of the plurality of slots. The sole structure further includes a plurality of bridges, each of which is connected to at least one of the plurality of ribs and spans one of the plurality of slots. The sole structure includes a second sole plate that is secured to the lower surface of the first sole plate both forward of the plurality of slots and rearward of the plurality of slots, and is detached from the plurality of ribs.

Each of the plurality of slots is configured to be open during dorsiflexion of the sole structure in a first portion of a flexion range, and closed during dorsiflexion of the sole structure in a second portion of the flexion range greater than the first portion of the flexion range, and the sole structure may provide a first bending stiffness in the first portion of the flexion range, and a second bending stiffness greater than the first bending stiffness in the second portion of the flexion range.

In an embodiment, the plurality of bridges includes respective sets of bridges each spanning a respective one of the plurality of slots. Adjacent ones of the respective sets of bridges are staggered in a transverse direction along the first sole plate.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., may be used descriptively relative to the figures, without representing limitations on the scope of the invention, as defined by the claims.

Figure 5:
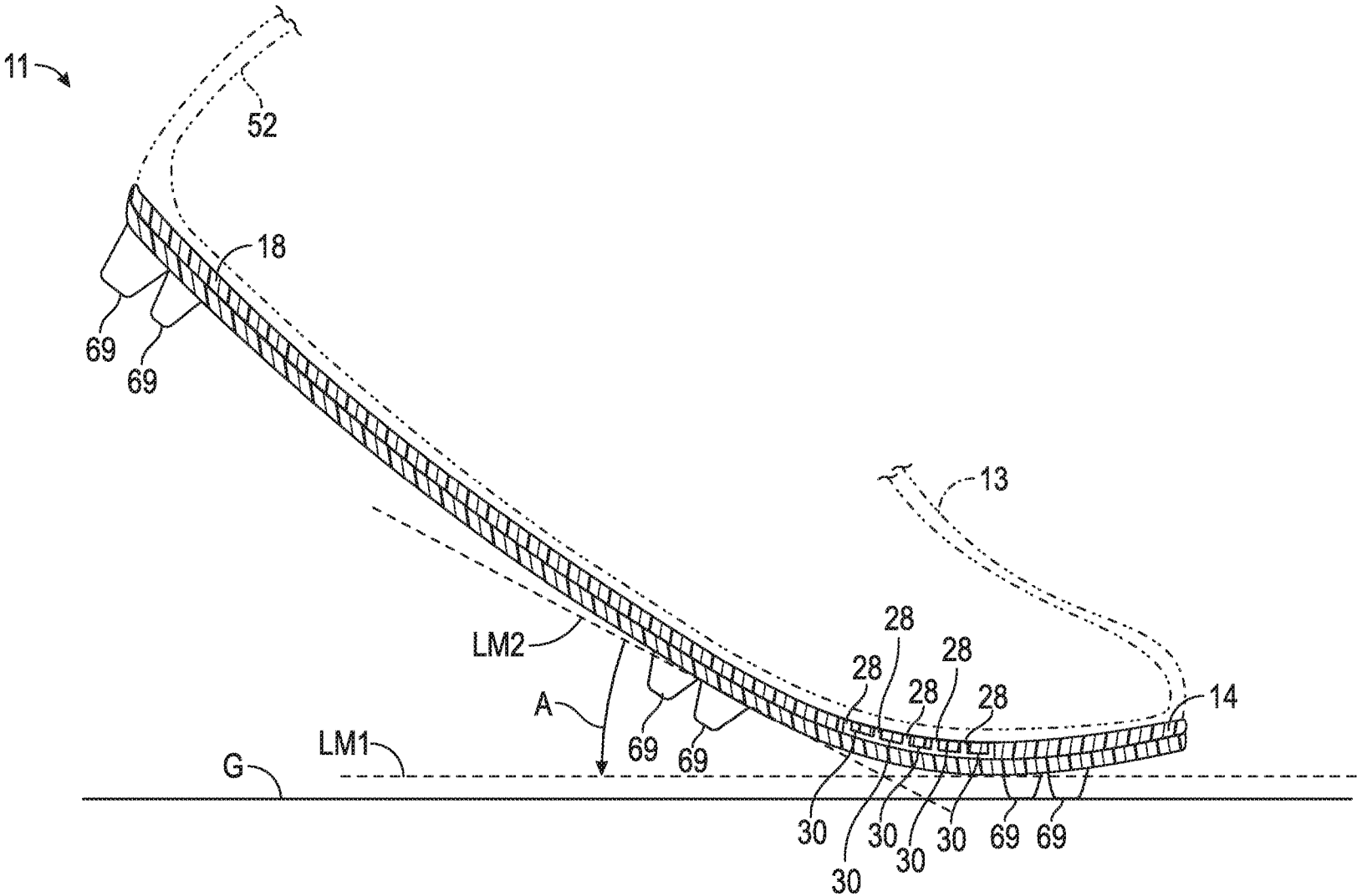
FIG. 5 is a schematic cross-sectional illustration of the sole structure of FIG. 1, taken along lines 5-5 in FIG. 1, flexed in a first portion of a flexion range.

Referring to the drawings, wherein like reference numbers refer to like components throughout the views, FIG. 1 shows a sole structure 10 for an article of footwear 11 shown in FIG. 5. The sole structure 10 has a resistance to flexion that increases with increasing dorsiflexion of the forefoot region 14 of the sole structure 10 (i.e., flexing of the forefoot region 14 in a longitudinal direction as discussed herein). As further explained herein, due to a first sole plate 12 with transversely extending slots 28 and ribs 30, the sole structure 10 provides an increase in bending stiffness when flexed in a longitudinal direction. More particularly, the sole structure 10 has a bending stiffness that is a piecewise function with a change at a first predetermined flex angle A1. The bending stiffness is tuned by the selection of various structural parameters discussed herein that determine the first predetermined flex angle A1. As used herein, "bending stiffness" may be used interchangeably with "bend stiffness".

Figure 2:
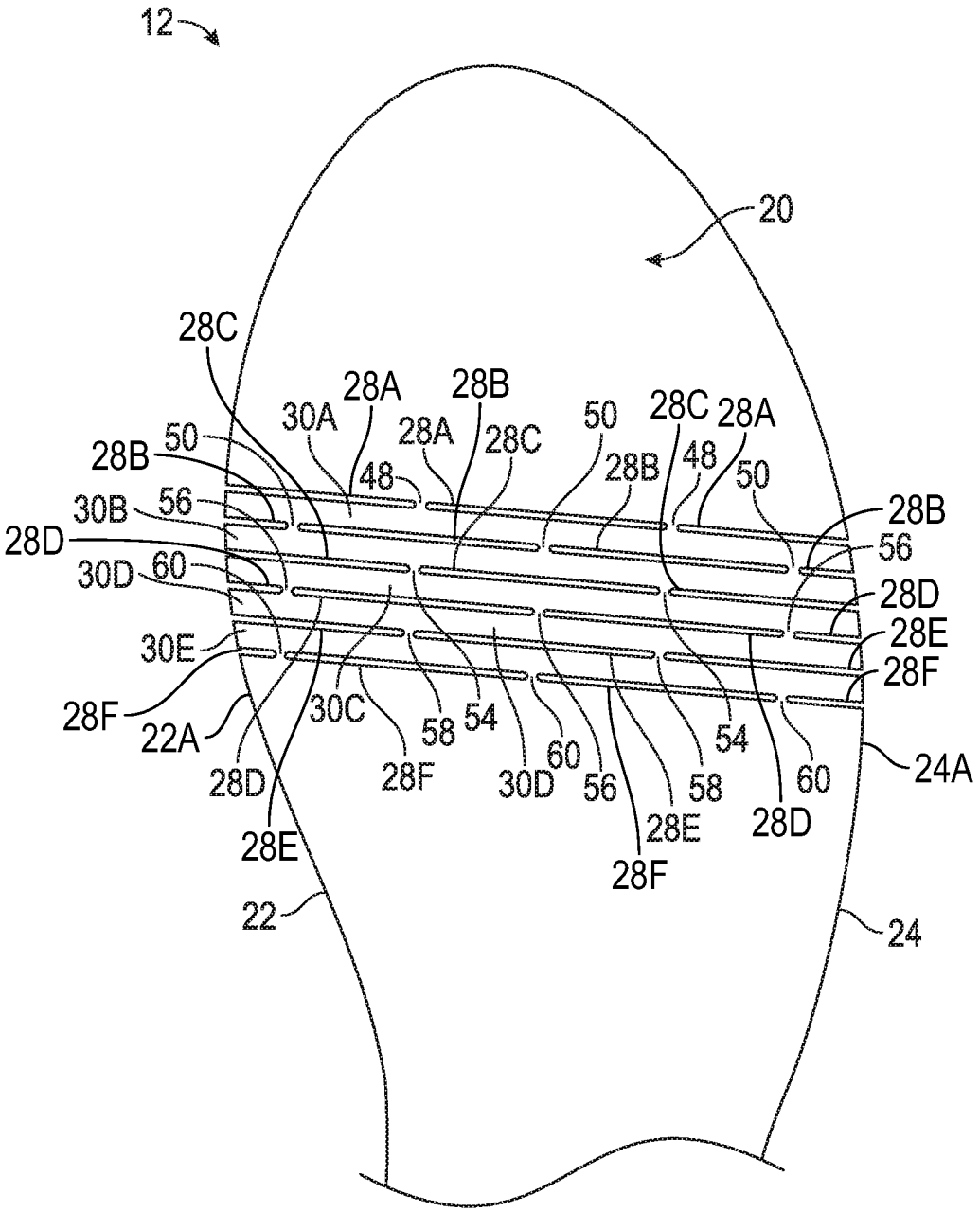
FIG. 2 is a schematic illustration in plan view of a foot-receiving surface of a first sole plate of the sole structure of FIG. 1.
Figure 3:
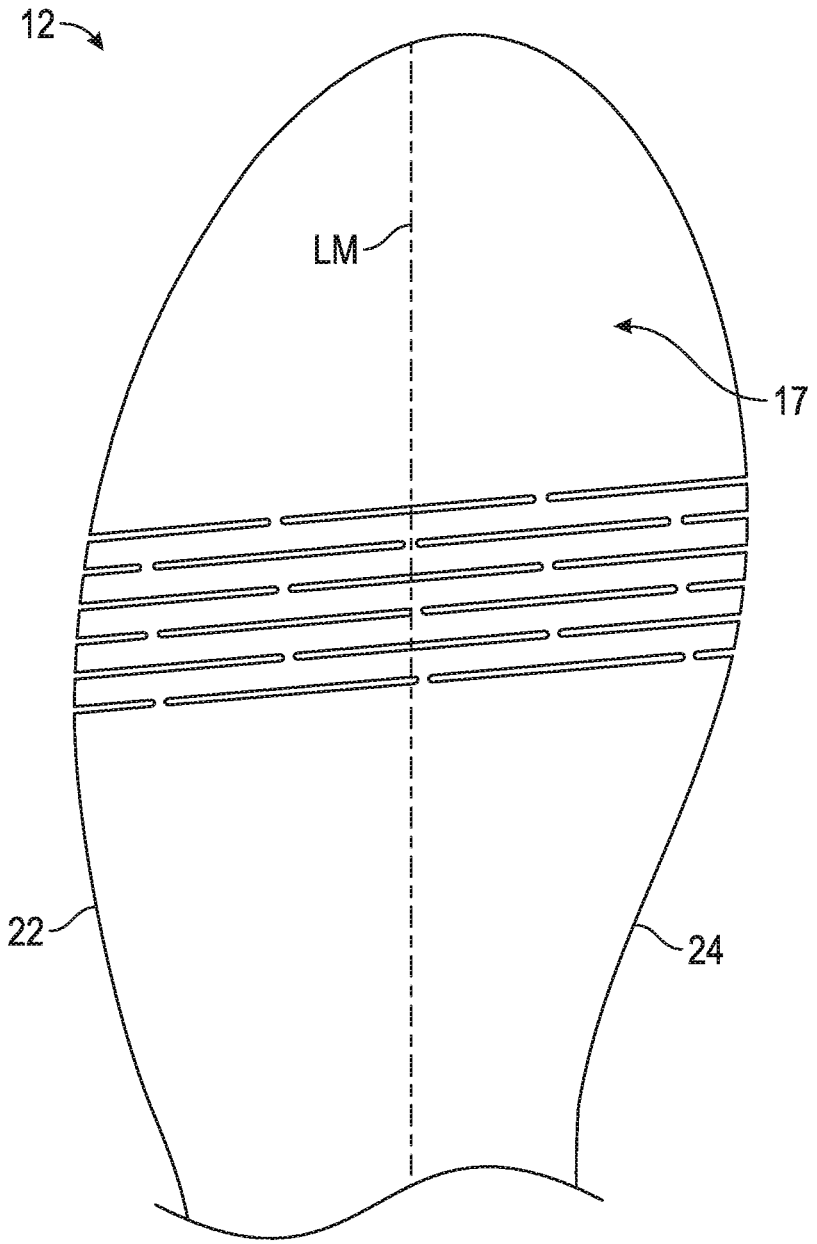
FIG. 3 is a schematic illustration in plan view of a lower surface of the first sole plate of the sole structure of FIG. 1.

Referring to FIGS. 1-3, the sole structure 10 includes a first sole plate 12, and may include one or more additional plates, layers, or components, as discussed herein. The article of footwear 11 includes an upper 13 (shown in phantom in FIG. 5). The first sole plate 12 is configured to be operatively connected to the upper 13 by stitching, bonding, or other suitable manner as readily understood by those skilled in the art. The upper 13 may incorporate a plurality of material elements (e.g., textiles, foam, leather, and synthetic leather) that are stitched or adhesively bonded together to form an interior void for securely and comfortably receiving a foot 52, represented in phantom in FIG. 5. The material elements may be selected and located with respect to the upper 13 in order to selectively impart properties of durability, air-permeability, wear-resistance, flexibility, and comfort, for example. An ankle opening provides access to the interior void. In addition, the upper 13 may include a lace or other tightening mechanism that is utilized to modify the dimensions of the interior void, thereby securing the foot 52 within the interior void and facilitating entry and removal of the foot 52 from the interior void. For example, a lace may extend through apertures in upper 13, and a tongue portion of the upper 13 may extend between the interior void and the lace. The upper 13 may exhibit the general configuration discussed above or a different configuration. Accordingly, the structure of the upper 13 may vary significantly within the scope of the present teachings.

The sole structure 10 is secured to the upper 13 and has a configuration that extends between the upper 13 and the ground G (included in FIG. 5). The first sole plate 12 may or may not be directly secured to the upper 13. In addition to attenuating ground reaction forces (i.e., providing cushioning for the foot 52), sole structure 10 may provide traction, impart stability, and limit various foot motions.

In the embodiment shown, the first sole plate 12 is a full-length, first sole plate 12 that has a forefoot region 14, a midfoot region 16, and a heel region 18. The first sole plate 12 provides a foot-receiving surface 20 (also referred to as a foot-facing surface) that extends over the forefoot region 14, the midfoot region 16, and the heel region 18. The foot-facing surface 20 supports the foot 52 but need not be in contact with the foot 52. For example, an insole, midsole, strobel, or other layers or components may be positioned between the foot 52 and the foot-facing surface 20.

A second sole plate 15 is secured to a lower surface 17 of the first sole plate 12. The lower surface 17 is opposite from the foot-receiving surface, and is best shown in FIG. 3. The second sole plate 15 is operatively secured to the ground-facing surface 17 of the first sole plate 12. As used herein, the second sole plate 15 is "operatively secured" to the first sole plate 12 when it is directly or indirectly attached to the first sole plate 12. For example, the second sole plate 15 may be adhered or friction welded to the first sole plate 12.

The second sole plate 15 also has a forefoot region 14, a midfoot region 16, and a heel region 18. In other embodiments, either or both of the first sole plate 12 and the second sole plate 15 may be a partial length plate. For example, in some cases, the first sole plate 12 may include only a forefoot region 14 that may be operatively connected to other components of the article of footwear that comprise a midfoot portion and a heel portion. As shown, both the first sole plate 12 and the second sole plate 15 extend from a medial side 22 to a lateral side 24. As used herein, a lateral side of a component for an article of footwear, including the lateral side 24 of the first sole plate 12, is a side that corresponds with an outside area of the human foot 52 (i.e., the side closer to the fifth toe of the wearer). The fifth toe is commonly referred to as the little toe. A medial side of a component for an article of footwear, including the medial side 22 of the first sole plate 12, is the side that corresponds with an inside area of the human foot 52 (i.e., the side closer to the hallux of the foot of the wearer). The hallux is commonly referred to as the big toe. Both the lateral side 24 and the medial side 22 extend from a foremost extent 25 to a rearmost extent 29 of a periphery of the first sole plate 12.

The term "longitudinal," as used herein, refers to a direction extending along a length of the sole structure 10, e.g., extending from the forefoot region 14 to the heel region 18 of the sole structure 10. The term "forward" is used to refer to the general direction from the heel region 18 toward the forefoot region 14, and the term "rearward" is used to refer to the opposite direction, i.e., the direction from the forefoot region 14 toward the heel region 18. The term "anterior" is used to refer to a front or forward component or portion of a component. The term "posterior" is used to refer to a rear or rearward component or portion of a component.

The heel region 18 generally includes portions of the first sole plate 12 corresponding with rear portions of a human foot, including the calcaneus bone, when the human foot is supported on the sole structure 10 and is a size corresponding with the sole structure 10. The forefoot region 14 generally includes portions of the first sole plate 12 corresponding with the toes and the joints connecting the metatarsal bones with the phalange bones of the human foot (interchangeably referred to herein as the "metatarsal-phalangeal joints" or "MPJ" joints). The midfoot region 16 generally includes portions of the first sole plate 12 corresponding with an arch area of the human foot, including the navicular joint. Regions 14, 16, 18 are not intended to demarcate precise areas of the sole structure 10. Rather, regions 14, 16, 18 are intended to represent general areas relative to one another, to aid in the following discussion. In addition to the sole structure 10, the regions 14, 16, 18, and medial and lateral sides 22, 24 may also be used to describe relative portions of the upper 13, the article of footwear 11, and individual components thereof.

The first sole plate 12 is referred to as a plate, but is not necessarily flat and need not be a single component but instead can be multiple interconnected components. For example, both the foot-facing surface 20 and the opposite ground-facing surface 17 may be pre-formed with some amount of curvature and variations in thickness when molded or otherwise formed in order to provide a shaped footbed and/or increased thickness for reinforcement in desired areas. For example, the first sole plate 12 could have a curved or contoured geometry that may be similar to the lower contours of the foot 52. For example, the first sole plate 12 may have a contoured periphery that slopes upward toward any overlaying layers, such as a midsole component or the upper 13.

The first sole plate 12 may be entirely of a single, uniform material, or may have different portions comprising different materials. For example, a first material of the forefoot region 14 can be selected to achieve a particular bending stiffness in the forefoot region 14, while a second material of the midfoot region 16 and the heel region 18 can be a different material that has little effect on the bending stiffness of the forefoot region 14. By way of non-limiting example, the different materials can be over-molded onto or co-injection molded with the first portion. Example materials for the first sole plate 12 include durable, wear resistant materials such as but not limited to nylon, thermoplastic polyurethane, or carbon fiber.

In the embodiment shown, the first sole plate 12 and the second sole plate 15 together may be an inner board plate, also referred to as an inner board, an insole board, or a lasting board. In other embodiments, the first sole plate 12 and the second sole plate 15 together may be an outsole. Still further, the first sole plate 12 and the second sole plate 15 could together be a midsole plate or a unisole plate, or may be one of, or a unitary combination of any two or more of, an outsole, a midsole, and/or an insole (also referred to as an inner board plate).

Figure 4:
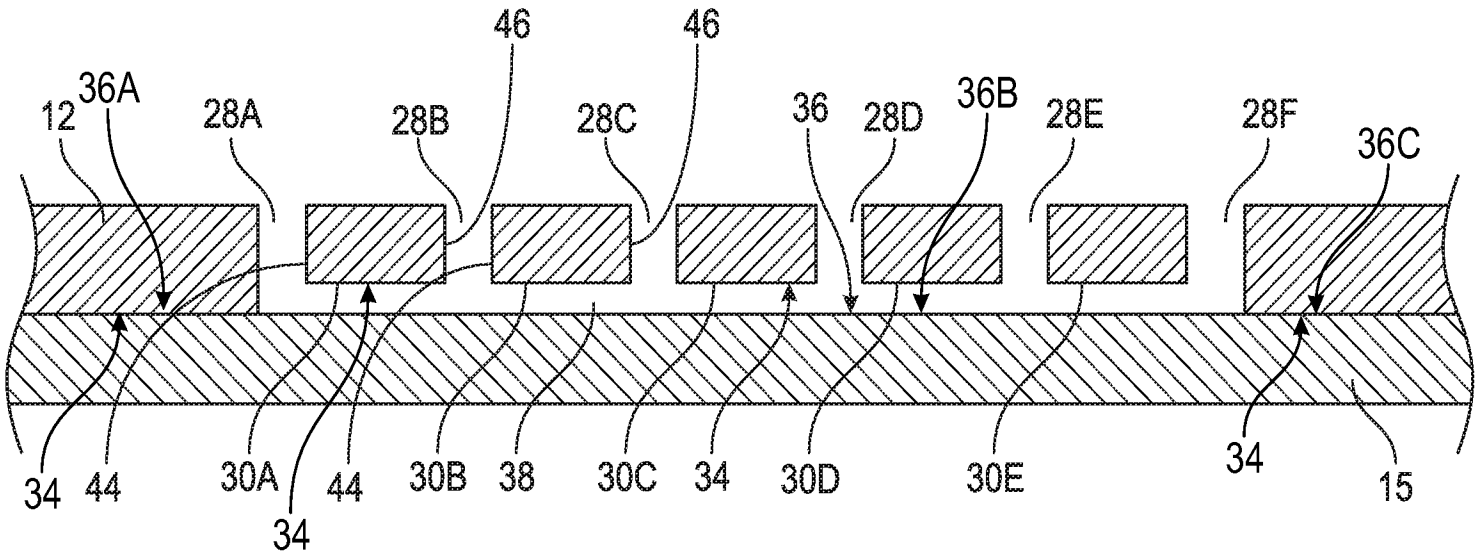
FIG. 4 is a schematic illustration in fragmentary and cross-sectional side view of the sole structure of FIG. 1 taken at lines 4-4 in FIG. 1.

The forefoot region 14 of the first sole plate 12 has a plurality of slots 28 spanned by bridges 48, 50, 54, 56, 58, and 60 as discussed herein. Stated differently, the first sole plate 12 has a slotted forefoot portion 14. Ribs 30 are disposed between the slots 28. Stated differently, a rib 30 separates each adjacent pair of slots 28. The slots 28 are disposed in the forefoot region 14 and extend generally transversely from a medial-most edge 22A of the first sole plate 12 at the medial side 22 of the first sole plate 12 to a lateral-most edge 24A of the first sole plate 12 at the lateral side 24 of the first sole plate 12, although may be slightly more forward at the medial side 22 than at the lateral side 24 as shown in FIG. 2 to generally follow the MPJ joints of the foot 52. The slots 28 are generally parallel with one another. The slots 28 extend entirely through the first sole plate 12 from the foot-receiving surface 20 to the lower surface 17, as shown in FIG. 1, and as is evident from the plan views of the foot-receiving surface 20 and the lower surface 17 in FIGS. 2 and 3. The slots 28 do not extend into the second sole plate 15. The second sole plate 15 is secured to the first sole plate 12 only forward of and rearward of the slots 28 and ribs 30, but is detached from the ribs 30. As best shown in FIG. 4, the lower surface 34 of the ribs 30 is displaced from an upper surface 36 of the second sole plate 15 by a vertical gap 38 when the sole structure 10 is in the relaxed, unflexed position of FIG. 1. The ribs 30 thus "float" above the upper surface 36 of the second sole plate 15. In other embodiments, the lower surface 34 may rest on the upper surface 36 even when the sole structure 10 is in the relaxed state, as shown and described with respect to the first sole plate 312 of the sole structure 310 of FIG. 11. As can be seen in FIG. 4, the upper surface 36 of the second sole plate 15 has a forward portion 36A, a rear portion 36C, and a midportion 36B disposed between the forward portion 36A and the rear portion 36C and connecting the forward portion 36A to the rear portion 36C. The forward portion 36A of the upper surface 36 of the second sole plate 15 is secured to the lower surface 34 of the first sole plate 12 forward of the plurality of slots 28A, 28B, 28C, 28D, 28E, and 28F, and the rear portion 36C of the upper surface 36 of the second sole plate 15 is secured to the lower surface 34 of the first sole plate 12 rearward of the plurality of slots 28A, 28B, 28C, 28D, 28E, and 28F. The midportion 36B of the upper surface 36 of the second sole plate 15 extends under and not into the plurality of slots 28A, 28B, 28C, 28D, 28E, and 28F, extends under and not above a lower surface 34 of the first rib 30A, and is detached from the first rib 30A.

Each of the plurality of slots 28 is open when the sole structure is in a relaxed, un-flexed state of FIG. 1. The slots 28 are also open during dorsiflexion of the sole structure in a first portion of a flexion range FR1, such as is illustrated in FIG. 5. However, with increasing dorsiflexion of the sole structure 10, the slots 28 eventually close. More specifically, the slots 28 close at the first predetermined flex angle A1 (shown in FIG. 6), and remain closed during a second portion of the flexion range FR2. The width of the slots 28, the number of the slots 28, and the overall thickness of the sole structure 10 determines the first predetermined flex angle A1.

Figure 6:
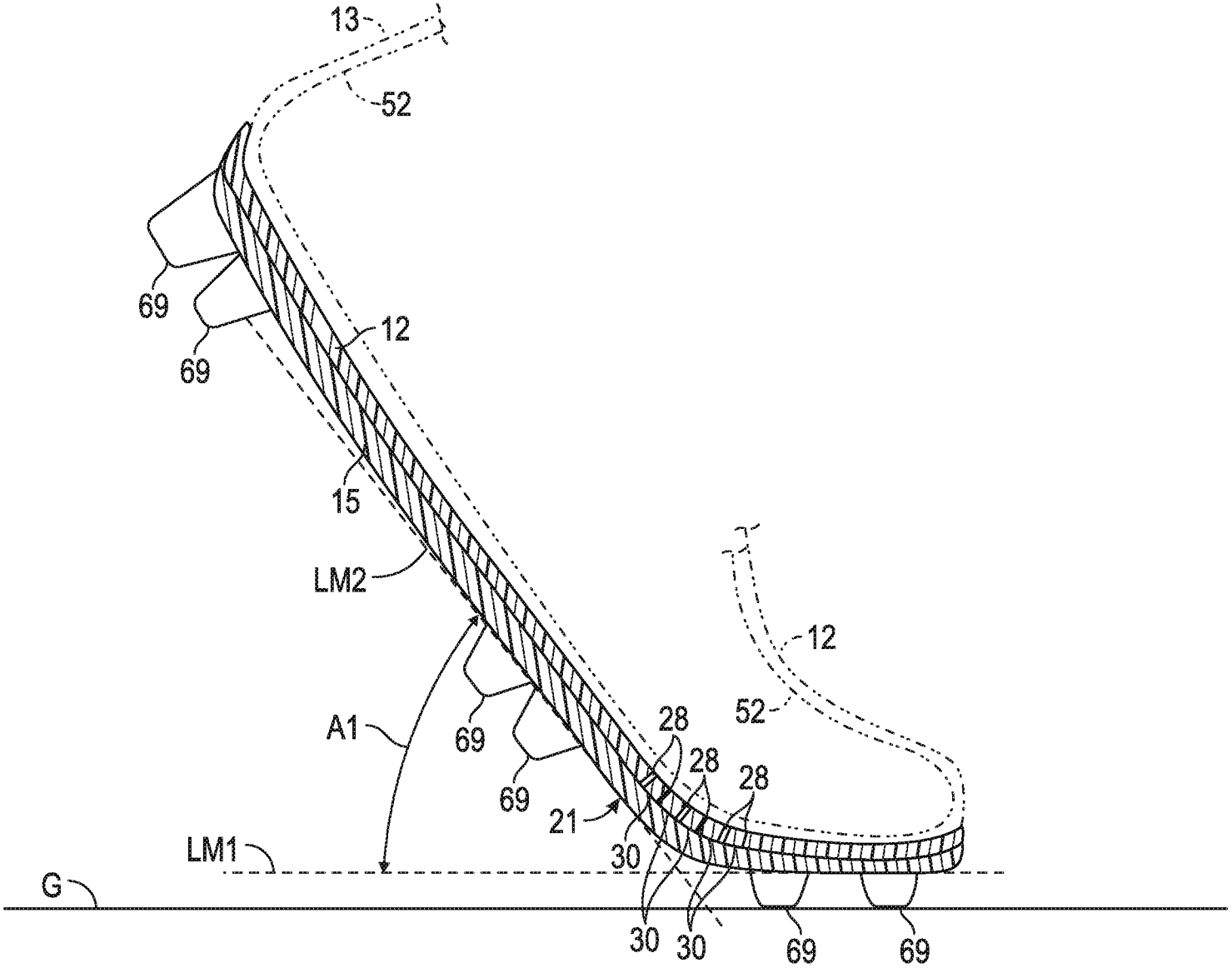
FIG. 6 is a schematic cross-sectional illustration of the sole structure of FIG. 5 flexed at a first predetermined flex angle.

Traction elements 69 are shown in FIGS. 5 and 6. The traction elements 69 may be integrally formed as part of the second sole plate 15, may be attached to the second sole plate 15, or may be formed with or attached to another plate underlying the second sole plate 15, such as if the first and second sole plates 12, 15 are an inner board plate and the sole structure 10 includes an underlying outsole. For example, the traction elements 69 may be integrally formed cleats. In other embodiments, the traction elements may be, for example, removable spikes. The traction elements 69 protrude below the ground-facing surface 21 of the second sole plate 15. Direct ground reaction forces on the second sole plate 15 immediately below the slots 28 that could affect operation of the slots 28 are thus minimized. In other embodiments, however, the sole structure 10 may have no traction elements 69, the ground-facing surface 21 may be the ground-contact surface, or other plates or components may underlie the second sole plate 15.

Figure 7:
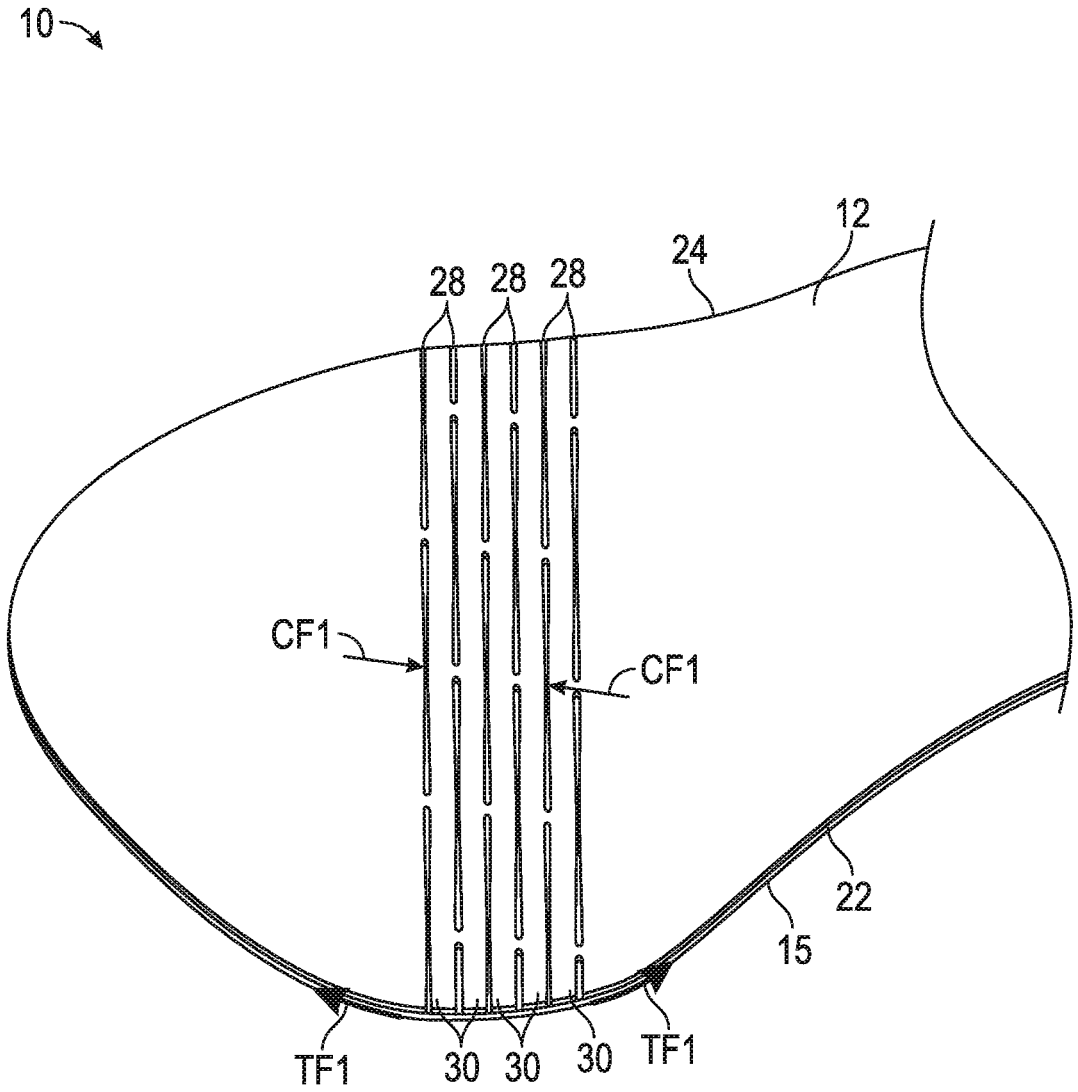
FIG. 7 is a schematic illustration in fragmentary perspective view of the sole structure of FIG. 6 at the first predetermined flex angle.

FIG. 6 shows that the slots 28 close during dorsiflexion of the sole structure 10 in a second portion of the flexion range FR2 greater than the first portion of the flexion range FR1. In other words, the second portion of the flexion range FR2 includes flex angles greater than those of the first portion of the flexion range FR1. More specifically, the number of slots 28 and the width of the slots 28 are configured so that the slots 28 close at the predetermined flex angle A1 shown in FIG. 6. As described herein and as best shown in FIG. 7, portions of the slots 28 immediately adjacent the bridges remain open while portions of the slots approximately midway between the bridges close, as indicated by the gaps shown between some of the ribs 30 at the cross-section of FIG. 6. The slots 28 are open at flex angles less than the predetermined flex angle A1, such as at flex angle A of FIG. 5. When the slots 28 close, the lower surfaces of the ribs 30 may contact the surface 36 of the second sole plate 15 toward the middle of the plurality of slots 28.

The resistance to flexion and the bending stiffness of the forefoot region 14 of the sole structure 10 in the first portion of the flexion range FR1 is influenced by the thickness of the second sole plate 15, but not significantly by the first sole plate 12, as the open slots 28 allow the ribs 30 to move unrestrained in the first portion of the flexion range FR1, such as when flexed at angle A shown in FIG. 5. The slots 28 narrow during the first portion of the flexion range FR1, but remain open.

The plurality of slots 28 include a first slot 28A and a second slot 28B rearward of the first slot 28A, as shown in FIGS. 2 and 4. The ribs 30 include a first rib 30A disposed between the first slot 28A and the second slot 28B. In some embodiments, there may be only two slots and one rib between the slots. The embodiment of FIGS. 1-7 has numerous additional slots and ribs, however, including a third slot 28C disposed rearward of the second slot 28B, and a second rib 30B disposed between the second slot 28B and the third slot 28C. The first rib 30A has a front wall 44 and a rear wall 46. The front wall 44 of the first rib 30A faces the first slot 28A, and the rear wall 46 of the first rib 30A faces the second slot 28C. The second rib 30B similarly has a front wall 44 and a rear wall. The front wall 44 of the second rib 30B faces the second slot 28B, and the rear wall 46 of the second rib 30B faces the third slot 28C. The second sole plate 15 is secured to the lower surface of the first sole plate 12 both forward of the plurality of slots 28 and rearward of the plurality of slots 28, but is detached from the ribs 30.

At a first predetermined flex angle A1, which is the beginning of a second portion of the flexion range FR2, further dorsiflexion of the sole structure 10 places the first sole plate 12 under compression, and the second sole plate 15 under increased tension, causing a corresponding increase in resistance to flexion and bending stiffness of the sole structure 10. More specifically, at the first predetermined flex angle A1, the slots 28 close. As used herein, the slots 28 "close" when at least a portion of the rear wall 46 of a rib 30 forward of the slot 28 (or, in the case of the forwardmost slot 28, a portion of the sole plate 12 forward of the forwardmost slot 28) contacts at least a portion of a front wall 44 of a rib 30 rearward of the slot 28 (or, in the case of the rearmost slot 28, a portion of the sole plate 12 rearward of the rearmost slot 28). The first slot 28A closes by a portion of the first sole plate 12 forward of the first slot 28A contacting the front wall 44 of the first rib 30A. The second slot 28B closes by the rear wall 46 of the first rib 30A contacting the front wall 44 of the second rib 30B. The third slot 28C closes by the rear wall 46 of the second rib 30B contacting the front wall 44 of the third rib 30C. Two additional ribs 30D, 30E and three additional slots 28D, 28E, and 28F are shown in FIG. 4.

When the slots 28 close, only a portion of an adjacent front wall 44 and rear wall 46 facing a slot 28 may contact one another. This is due to two factors. First, bridges 48, 50, 54, 56, 58, and 60 spanning the slots 28 and connecting adjacent ribs 30 tend to prevent the portions of the walls 44, 46 immediately adjacent the bridges 48, 50, 54, 56, 58, and 60 from contacting one another. FIG. 7 illustrates this effect of the bridges 48, 50, 54, 56, 58, and 60 and is discussed herein. Additionally, the bending of the sole structure 10 is about a bend axis above the foot-receiving surface 20 of the first sole plate 12, causing portions of the walls 44, 46 closer to the bend axis to be in greater compression than portions further from the bend axis. For example, the dorsal edges of the walls 44, 46 may touch each other first with portions of the walls 44, 46 between the dorsal edges coming into contact with one another with increasing dorsiflexion. The sole structure 10 may be configured with a thickness so that a neutral bend axis is below the first sole plate 12, such as at the upper surface 36 of the second sole plate 15 or between the upper and lower surfaces 36, 21 of the second sole plate 15.

Because the slots 28 extend completely through the first sole plate 12 instead of being configured as a V-shaped or U-shaped groove in which the front and rear walls are connected near the bottom of the groove (i.e., near the bottom surface 17), a stress concentration that would otherwise occur at the bottom of the groove is eliminated. Instead, stress is spread over the entire width of the plurality of slots 28 (i.e., from the portion of the first sole plate 12 just forward of the first slot 28A to the portion of the first sole plate 12 just rearward of the slot 28F). However, the predetermined flex angle A1 is much lower than it would be with a single groove having a width equivalent to the width of the plurality of slots 28, as the ribs 30 and bridges 48, 50, 54, 56, 58, 60 reduce the predetermined flex angle to that corresponding with the sum of the widths of one-half of the slots 28, as discussed herein.

FIG. 2 shows that the first sole plate 12 includes a first set of bridges 48. Each bridge 48 is spaced transversely apart from each other bridge 48 and spans the first slot 28A. Each bridge 48 connects the first rib 30A with a portion of the first sole plate 12 forward of the first rib 30A. The first sole plate 12 also includes a second set of bridges 50. Each bridge 50 is spaced transversely apart from each other bridge 50 and spans the second slot 28B. Each bridge 50 connects the first rib 30A with a portion of the first sole plate 12 rearward of the first rib 30A, which in the embodiment shown is the second rib 30B. The bridges 48 of the first set of bridges are staggered along the first sole plate 12 in a transverse direction relative to the bridges 50 of the second set of bridges. In an alternative embodiment, the sole plate 12 may have only one first bridge 48 and only one bridge 50. In an embodiment with more than two slots 28, such as the embodiment shown, additional sets of bridges are disposed between each remaining pair of adjacent ribs and between the rearmost rib and a portion of the first sole plate 12 rearward of the rearmost rib. For example, the first sole plate 12 includes a third set of bridges 54. Each bridge 54 of the third set of bridges is spaced transversely apart from each other bridge 54 of the third set of bridges and spans the third slot 28C. Each bridge 54 connects the second rib 30B with a portion of the first sole plate 12 rearward of the second rib 30B, which, in the embodiment shown, is the third rib 30C. Similarly, bridges 56 are spaced transversely apart from one another and span the slot 28D and connect the third rib 30C with the fourth rib 30D. Bridges 58 are spaced transversely apart from one another and span slot 28E and connect the fourth rib 30D with the fifth rib 30E. Bridges 60 are spaced transversely apart from one another and span the slot 28F and connect the fifth rib 30E with the portion of the sole plate 12 rearward of the fifth rib 30E.

All of the bridges 48, 50, 54, 56, 58, and 60 are integral with the first sole plate 12 in the embodiment shown. For example, the first sole plate 12 may be an integral, one-piece component. In other embodiments, the bridges 48, 50, 54, 56, 58, and 60 could be separate components that connect the ribs 30. The bridges 48, 50, 54, 56, 58, and 60 serve to keep the ribs 30 moving during dorsiflexion as a unit so that the slots 28 will close in unison. The bridges 48, 50, 54, 56, 58, and 60 of each set are spaced transversely apart from one another to allow the bowed contact between the ribs 30 with relatively low stress on the bridges.

Alternating sets of bridges 48, 50, 54, 56, 58, and 60 are aligned with one another generally in a longitudinal direction along the sole plate 12, but are staggered along the first sole plate 12 in a generally transverse direction (i.e., from the medial side 22 to the lateral side 24) relative to adjacent sets of bridges. Alternating sets of bridges 48, 50, 54, 56, 58, and 60 are those bridges that span alternating slots 28. For example, the third set of bridges 54 is aligned with the first set of bridges 48 as well as with the bridges 58 in a generally longitudinal direction along the first sole plate 12. The bridges 48, 54, and 58 are aligned in that each respective bridge 48 falls along a common line with a respective one of the bridges 54 and with a respective one of the bridges 58, and the common line is generally perpendicular to lines along the length of each of the slots 28A, 28C, and 28E. Similarly, the second set of bridges 50 is aligned with the bridges 56 and with the bridges 60. Stated differently, each respective bridge 50 falls along a common line with a respective one of the bridges 56 and with a respective one of the bridges 60, and the common line is generally perpendicular to lines along the length of each of the slots 28A, 28C, and 28E. The aligned bridges 48, 54, 58 are staggered relative to the aligned bridges 50, 56, 60.

As indicated in FIG. 7, when the sole structure 10 is sufficiently dorsiflexed (i.e., at a flex angle greater than or equal to the first predetermined flex angle A1), adjacent ribs 30 contact one another at their adjacent, facing front and rear walls 44, 46 between the bridges 48, 50, 54, 56, 58, and 60. Each bridge prevents the slot 28 across which it spans from closing in the immediate vicinity of the bridge. Dorsiflexion of the sole structure 10 causes the ribs 30 to bow slightly approximately midway between adjacent bridges 48, 50, 54, 56, 58, and 60 to contact a rearward or a forward rib 30 or portion of the first sole plate 12. Thus, the slots 28 close in a longitudinal direction only between the aligned bridges 48, 50, 54, 56, 58, and 60. Cumulatively, in a longitudinal direction along a line extending through alternating sets of bridges (e.g., bridges 48, 54, 58, or bridges 50, 56, 60), the line extends through every other closed slot 28. The predetermined flex angle A1 at which the adjacent ribs 30 will contact one another as described is dependent on the sum of the widths of one half of the number of slots 28, or, assuming each slot 28 has the same width, three times the width, as there are a total of six slots.

With reference to FIGS. 5 and 6, the first predetermined flex angle A1 is defined as the angle formed at the intersection between a first axis LM1 and a second axis LM2, where the first axis LM1 generally extends along a longitudinal midline LM at the ground-facing surface 21 of second sole plate 15 anterior to the slots 28, and the second axis LM2 generally extends along the longitudinal midline LM of the second sole plate 15 at the ground-facing surface 21 of the second sole plate 15 posterior to the slots 28. The first sole plate 12 is configured so that the intersection of the first and second axes LM1 and LM2 will typically be approximately centered both longitudinally and transversely below the slots 28 discussed herein, and below the metatarsal-phalangeal joints of the foot 52 supported on the foot-receiving surface 20. By way of non-limiting example, the first predetermined flex angle A1 may be from about 30 degrees (°) to about 65°. In one exemplary embodiment, the first predetermined flex angle A1 is found in the range of between about 30° and about 60°, with a typical value of about 55°. In another exemplary embodiment, the first predetermined flex angle A1 is found in the range of between about 15° and about 30°, with a typical value of about 25°. In another example, the first predetermined flex angle A1 is found in the range of between about 20° and about 40°, with a typical value of about 30°. In particular, the first predetermined flex angle can be any one of 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, or 65°.

The sole structure 10 will bend in dorsiflexion in response to forces applied by corresponding bending of a user's foot at the MPJ during physical activity. Throughout the first portion of the flexion range FR1, bending stiffness (defined as the change in moment as a function of the change in angle) will remain approximately the same as bending progresses through increasing angles of flexion. Because bending within the first portion of the flexion range FR1 is primarily governed by inherent material properties of the materials of the second sole plate 15, a graph of torque on the sole structure 10 versus angle of flexion (the slope of which is the bending stiffness) in the first portion of the flexion range FR1 will typically demonstrate a smoothly but relatively gradually inclining curve (referred to herein as a "linear" region with constant bending stiffness). In the first portion of the flexion range FR1, compression forces of the first sole plate 12 are relieved by narrowing of the still open slots 28. At the boundary between the first and second portions of the range of flexion FR1 and FR2 (i.e. at the first predetermined flex angle A1, which is the beginning of the second range of flexion FRs), however, the abutment of the front walls 44 with the rear walls 46 of the adjacent ribs 30 at the slots 28 (or with a portion of the first sole plate 12 forward of the forwardmost slot 28A, and a portion of the first sole plate 12 rearward of the rearmost slot 28F) as discussed herein engages additional material and mechanical properties that exert a notable increase in resistance to further dorsiflexion (i.e., the first sole plate 12 is placed under markedly increased compression, and the second sole plate 15 is placed under increased tension as a result).

Therefore, a corresponding graph of torque versus angle of deflection (the slope of which is the bending stiffness) that also includes the second portion of the flexion range FR2 would show—beginning at an angle of flexion approximately corresponding to angle A1—a departure from the gradually and smoothly inclining curve characteristic of the first portion of the flexion range FR1. This departure is referred to herein as a "nonlinear" increase in bend stiffness, and would manifest as either or both of a stepwise increase in bending stiffness and/or a change in the rate of increase in the bending stiffness. The change in rate can be either abrupt, or it can manifest over a short range of increase in the bend angle of the sole structure 10. In either case, a mathematical function describing a bending stiffness in the second portion of the flexion range FR2 will differ from a mathematical function describing bending stiffness in the first portion of the flexion range FR1.

Figure 8:
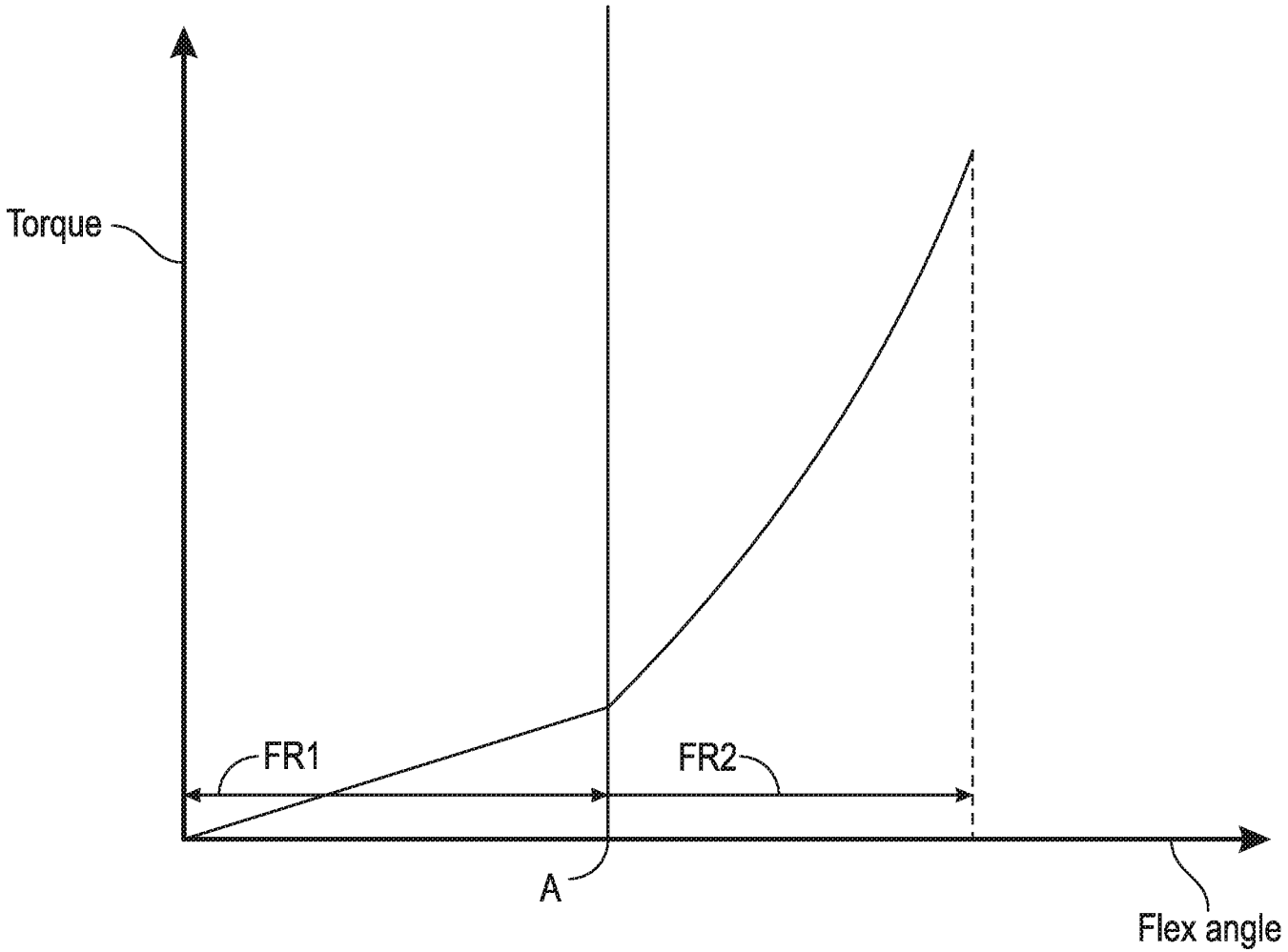
FIG. 8 is a plot of torque versus flex angle for the sole structure of FIGS. 1-7.

FIG. 8 is an example plot depicting an expected increase in resistance to flexion at increasing flex angles, as exhibited by the increasing magnitude of torque (shown on the vertical axis) required at the heel region 18 for dorsiflexion of the forefoot region 14 (shown as flex angles on the horizontal axis). The bending stiffness in the first range of flexion FR1 (i.e., the first bending stiffness) may be constant (thus the plot would have a linear slope) or substantially linear or may increase gradually (which would show a change in slope in the first portion of the flexion range FR1). The bending stiffness in the second portion of the flexion range FR2 (i.e., the second bending stiffness) may be linear or nonlinear, but will depart from the bending stiffness of the first range of flexion FR1 at the first predetermined flex angle A1, either markedly or gradually (such as over a range of several degrees) at the first predetermined flex angle A1 due to the abutment of adjacent ribs 30 or abutment of ribs 30 with portions of the sole plate 12 (in the case of the front wall 44 of the forward-most rib 30, and the rear wall 46 of the rearmost rib 30) when the slots 28 close. The sole structure 10 thus provides a first bending stiffness in the first portion of the flexion range FR1, and a second bending stiffness greater than the first bending stiffness in the second portion of the flexion range FR2.

Functionally, when the first sole plate 12 is dorsiflexed in the first portion of the flexion range FR1, as shown in FIG. 5, the slots 28 narrow but remain open, with no portion of adjacent front and rear walls 44, 46 in contact with one another. During this first portion of the flexion range FR1, the first sole plate 12 and the second sole plate 15 bend relatively freely. When the flex angle of the sole structure 10 reaches the first predetermined flex angle A1, longitudinally opposing tensile forces directed outwardly along the longitudinal midlines LM1 and LM2 can no longer be relieved by the narrowing slots 28, as they would throughout the first portion of the flexion range FR1. Instead, further bending of the sole structure 10 is additionally constrained by the first sole plate's 12 resistance to compressive shortening and deformation in response to the progressively increasing compressive forces applied along its longitudinal axis LM, and by the second sole plate's 15 resistance to tension in response to the tensile forces applied along its longitudinal axis. Accordingly, the compressive and tensile characteristics of the material(s) of the first and second sole plates 12, 15, respectively, play a large role in determining a change in bending stiffness of the sole structure 10 as it transitions from the first portion of the flexion range FR1, to and through the second portion of the flexion range FR2.

With reference to FIGS. 5-6, as the foot 52 flexes by lifting the heel region 18 away from the ground G while maintaining contact with the ground G at a forward portion of the article of footwear 11 corresponding with a forward portion of the forefoot region 14 (i.e., the foot 52 is dorsiflexed), it places torque on the sole structure 10 and causes the first sole plate 12 to flex at the forefoot region 14.

As will be understood by those skilled in the art, during bending of the first sole plate 12 as the foot 52 is dorsiflexed, there is a layer in the first sole plate 12 referred to as a neutral plane (although not necessarily planar) or a neutral axis above which the first sole plate 12 is in compression, and below which the first sole plate 12 is in tension. The interference of the abutting ribs 30 when the slots 28 close causes additional compressive forces CF1 (indicated in FIG. 7) on the first sole plate 12 above the neutral plane, and additional tensile forces TF2 on the second sole plate 15 below the neutral plane, nearer the ground-facing surface 21.

In addition to the mechanical (e.g., tensile, compression, etc.) properties of the selected material of the first sole plate 12 and the second sole plate 15, structural factors that likewise affect changes in bend stiffness during dorsiflexion include but are not limited to the thicknesses, the longitudinal lengths, and the medial-lateral widths of the first sole plate 12 and the second sole plate 15.

Figure 9:
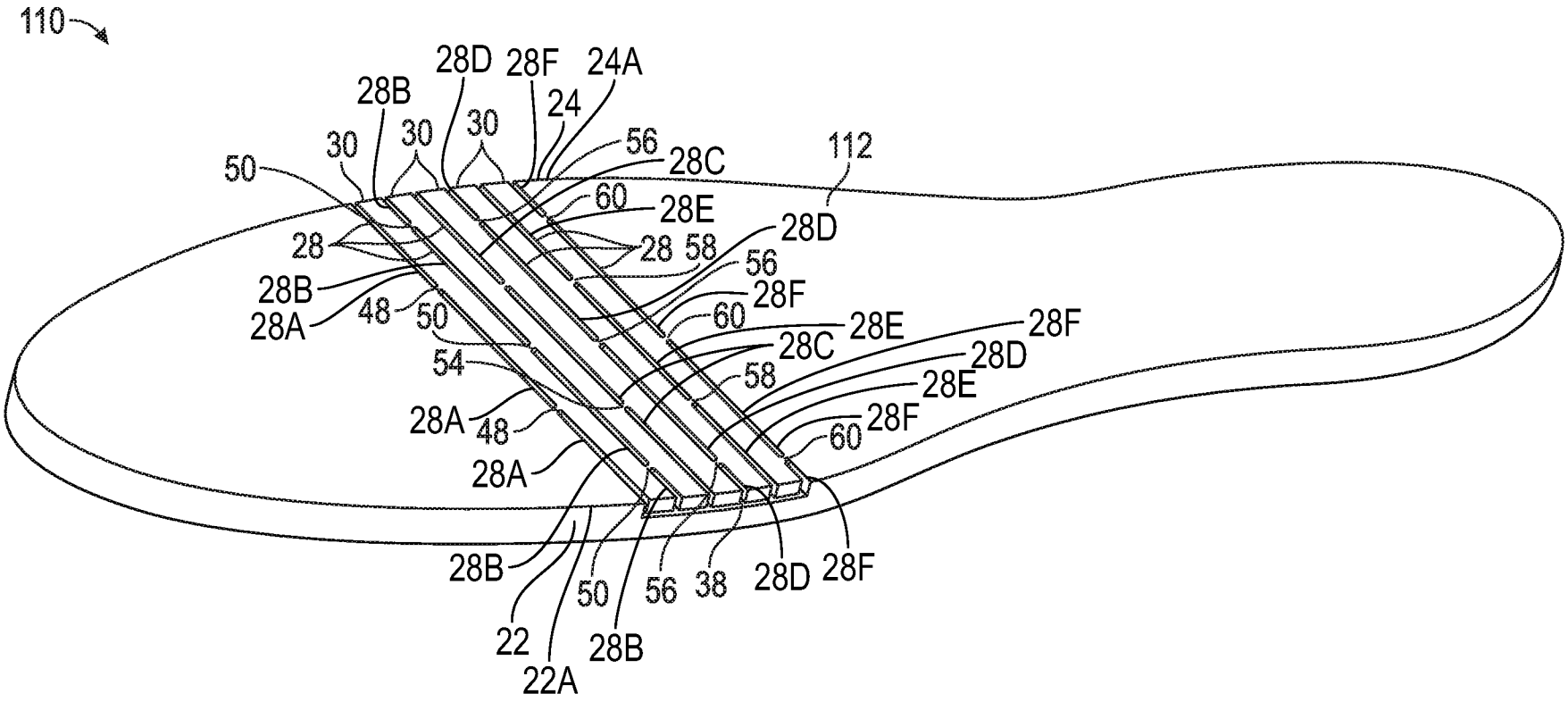
FIG. 9 is a schematic illustration in perspective view of an alternative embodiment of a sole structure for an article of footwear in an unflexed position in accordance with an alternative aspect of the present teachings.

FIG. 9 shows an alternative embodiment of a sole structure 110 that is a unisole plate, with a single sole plate 112 instead of a first sole plate 12 secured to a second sole plate. The same slots 28, ribs 30 and bridges 48, 50, 54, 56, 58, 60 are present in the embodiment shown, and a vertical gap 38 exists between the lower surface of the ribs 30 and a remainder of the sole plate 112 directly below the ribs 30.

Figure 10:
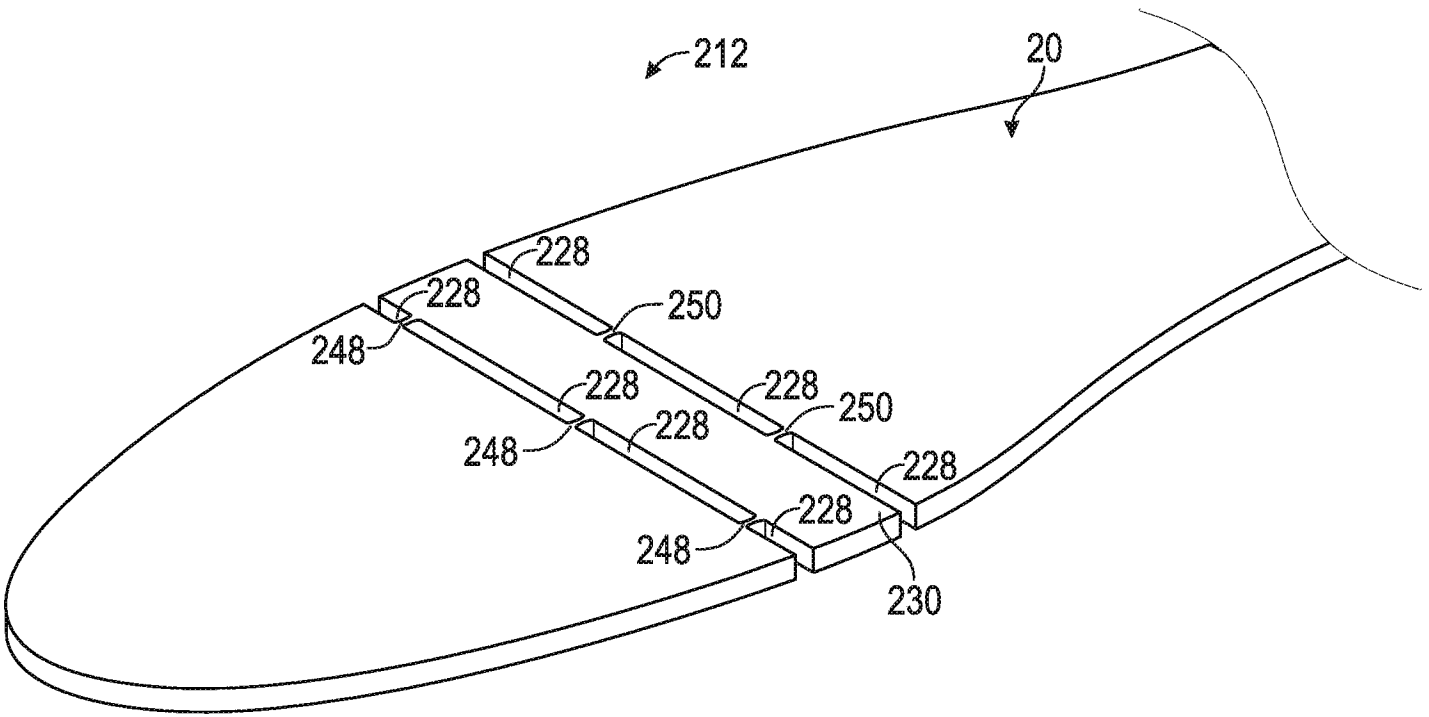
FIG. 10 is a schematic illustration in perspective view of another alternative embodiment of a sole structure for an article of footwear in an unflexed position in accordance with an alternative aspect of the present teachings.

FIG. 10 shows an alternative embodiment of a first sole plate 212 for use with the second sole plate 15 in lieu of the first sole plate 12 in the sole structure 10 of FIG. 1. The first sole plate 212 has only two slots 228 that are wider than the slots 28, and only one rib 230 that is wider than the ribs 30. Bridges 248, 250 span the slots 228.

Figure 11:
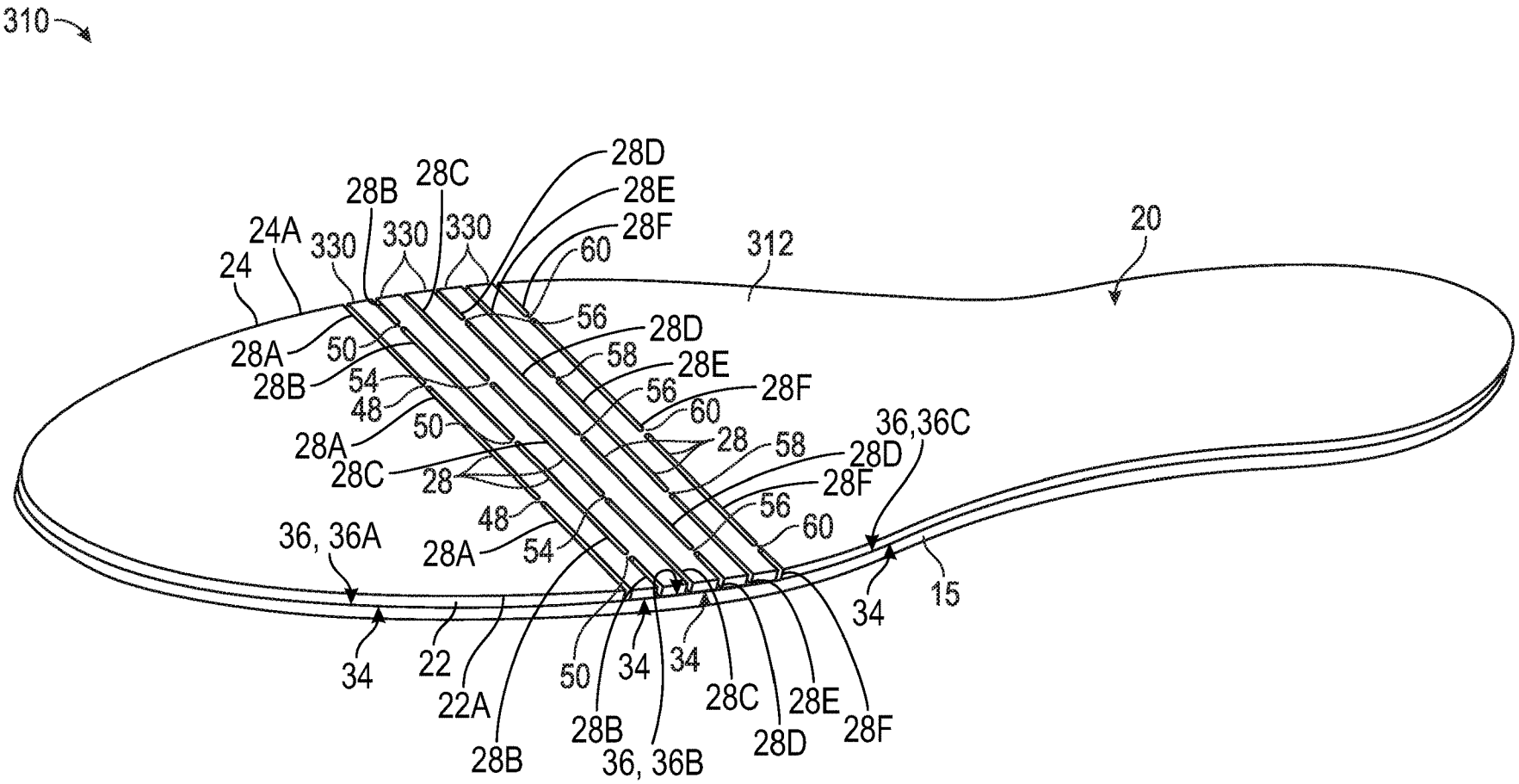
FIG. 11 is a schematic illustration in perspective view of another alternative embodiment of a sole structure for an article of footwear in an unflexed position in accordance with an alternative aspect of the present teachings.

FIG. 11 shows another alternative embodiment of a sole structure 310 alike in all aspects to the sole structure 10 except that the first sole plate 12 is replaced with a first sole plate 312 having ribs 330 sufficiently thick in height that the lower surface 34 of the ribs 330 rests on the upper surface 36 of the second sole plate 15 even when the sole structure 310 is in a relaxed, unflexed state as shown. The forward portion 36A of the upper surface 36 of the second sole plate 15 is secured to the lower surface 34 of the first sole plate 312 forward of the plurality of slots 28A, 28B, 28C, 28D, 28E, and 28F, and the rear portion 36C of the upper surface 36 of the second sole plate 15 is secured to the lower surface 34 of the first sole plate 312 rearward of the plurality of slots 28A, 28B, 28C, 28D, 28E, and 28F. The midportion 36B of the upper surface 36 of the second sole plate 15 extends under and not into the plurality of slots 28A, 28B, 28C, 28D, 28E, and 28F, and extends under and not above a lower surface 34 of the first rib 30A.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear, the sole structure comprising:

a first sole plate that includes:
- a forefoot region;
- a foot-receiving surface;
- a lower surface opposite the foot-receiving surface;
- a plurality of slots including:
  - a first slot;
  - a second slot rearward of the first slot; and
  - a third slot disposed in the forefoot region rearward of the second slot;
  - wherein the plurality of slots is disposed in the forefoot region and extends generally transversely and entirely through the first sole plate from the foot-receiving surface to the lower surface;
- a first rib disposed between the first slot and the second slot; and
- a second rib disposed between the second slot and the third slot;
- wherein the first rib and the second rib each have a front wall and a rear wall;
- wherein each of the plurality of slots is configured to be:
  - open during dorsiflexion of the sole structure in a first portion of a flexion range; and
  - closed during dorsiflexion of the sole structure in a second portion of the flexion range greater than the first portion of the flexion range; and
- wherein the rear wall of the first rib contacts the front wall of the second rib when the second slot closes;

a second sole plate having an upper surface, the upper surface having a forward portion, a rear portion, and a midportion disposed between the forward portion and the rear portion and connecting the forward portion to the rear portion, wherein the forward portion of the upper surface of the second sole plate is secured to the lower surface of the first sole plate forward of the plurality of slots, and the rear portion of the upper surface of the second sole plate is secured to the lower surface of the first sole plate rearward of the plurality of slots;

wherein the midportion of the upper surface of the second sole plate extends under and not into the plurality of slots, extends under and not above a lower surface of the first rib, and is detached from the first rib;

wherein the first slot and the second slot extend from a medial-most edge of the first sole plate at a medial side of the first sole plate to a lateral-most edge of the first sole plate at a lateral side of the first sole plate;

wherein the first sole plate includes a first set of bridges, a second set of bridges, and a third set of bridges;

wherein each bridge of the first set of bridges:
- is spaced transversely apart from each other bridge of the first set of bridges;
- spans the first slot; and
- connects the first rib with a portion of the first sole plate forward of the first rib;

wherein each bridge of the second set of bridges:
- is spaced transversely apart from each other bridge of the second set of bridges;
- spans the second slot; and
- connects the first rib with a portion of the first sole plate rearward of the first rib;

wherein bridges of the first set of bridges are staggered along the first sole plate in a transverse direction relative to bridges of the second set of bridges;

wherein each bridge of the third set of bridges:
- is spaced transversely apart from each other bridge of the third set of bridges;
- spans the third slot; and
- connects the second rib with a portion of the first sole plate rearward of the second rib; and wherein bridges of the third set of bridges are aligned with bridges of the first set of bridges in a longitudinal direction along the first sole plate.

2. The sole structure of claim 1, wherein each of the plurality of slots is configured to be:

open when the sole structure is in a relaxed, un-flexed state.

3. The sole structure of claim 2, wherein:

the first portion of the flexion range includes flex angles of the sole structure less than a first predetermined flex angle;

the second portion of the flexion range includes flex angles greater than or equal to the first predetermined flex angle; and the sole structure is configured to provide a change in bending stiffness at the first predetermined flex angle.

4. The sole structure of claim 3, wherein the first predetermined flex angle is an angle from 35 degrees to 65 degrees.

5. The sole structure of claim 2, wherein the sole structure is configured to provide a first bending stiffness in the first portion of the flexion range, and a second bending stiffness greater than the first bending stiffness in the second portion of the flexion range.

6. The sole structure of claim 1, wherein the second sole plate is displaced from the first rib by a vertical gap when the sole structure is in a relaxed, un-flexed state, the vertical gap being open to and in communication with the plurality of slots.

7. The sole structure of claim 1, wherein the first slot and the second slot are generally parallel with one another.

8. The sole structure of claim 1, wherein each bridge of the first set of bridges and each bridge of the second set of bridges is integral with the first sole plate.

9. The sole structure of claim 1, wherein the first sole plate is integral with the second sole plate.

10. The sole structure of claim 1, wherein the first sole plate is one of, or is a unitary combination of any two or more of: an outsole, a midsole, and an insole.

11. The sole structure of claim 1, wherein:

the first sole plate further includes a midfoot region and a heel region, and the second sole plate has a forefoot region, a midfoot region, and a heel region.

12. An article of footwear comprising:

an upper; and a sole structure including a first sole plate and a second sole plate;

wherein the first sole plate is secured to the upper and includes:

a forefoot region;

a foot-receiving surface facing the upper;

a lower surface opposite the foot-receiving surface;

a plurality of slots disposed in the forefoot region and extending generally transversely and entirely through the first sole plate from the foot-receiving surface to the lower surface; the plurality of slots including a first slot, a second slot rearward of the first slot, and a third slot rearward of the second slot;

a plurality of ribs; wherein each of the plurality of ribs is disposed between and defined by a respective pair of the plurality of slots;

wherein the plurality of ribs includes a first rib disposed between the first slot and the second slot, and a second rib disposed between the second slot and the third slot;

wherein the first rib and the second rib each have a front wall and a rear wall;

wherein each of the plurality of slots is configured to be:

open during dorsiflexion of the sole structure in a first portion of a flexion range; and closed during dorsiflexion of the sole structure in a second portion of the flexion range greater than the first portion of the flexion range; and wherein the rear wall of the first rib contacts the front wall of the second rib when the second slot closes;

a plurality of bridges including a first set of bridges, a second set of bridges, and a third set of bridges; wherein each of the plurality of bridges is connected to at least one of the plurality of ribs and spans one of the plurality of slots;

wherein each bridge of the first set of bridges:

is spaced transversely apart from each other bridge of the first set of bridges;

spans the first slot; and connects the first rib with a portion of the first sole plate forward of the first rib;

wherein each bridge of the second set of bridges:

is spaced transversely apart from each other bridge of the second set of bridges;

spans the second slot; and connects the first rib with a portion of the first sole plate rearward of the first rib;

wherein bridges of the first set of bridges are staggered along the first sole plate in a transverse direction relative to bridges of the second set of bridges;

wherein each bridge of the third set of bridges:

is spaced transversely apart from each other bridge of the third set of bridges;

spans the third slot; and connects the second rib with a portion of the first sole plate rearward of the second rib;

wherein bridges of the third set of bridges are aligned with bridges of the first set of bridges in a longitudinal direction along the first sole plate;

wherein the second sole plate is secured to the lower surface of the first sole plate both forward of the plurality of slots and rearward of the plurality of slots, and the plurality of ribs rest on an upper surface of the second sole plate; and wherein the plurality of slots extends from a medial-most edge of the first sole plate at a medial side of the first sole plate to a lateral-most edge of the first sole plate at a lateral side of the first sole plate.

13. The article of footwear of claim 12, wherein the sole structure is configured to provide a first bending stiffness in the first portion of the flexion range, and a second bending stiffness greater than the first bending stiffness in the second portion of the flexion range.

* * * * *